US006595886B1

(12) United States Patent
Forster

(10) Patent No.: US 6,595,886 B1
(45) Date of Patent: Jul. 22, 2003

(54) HYDROSTATIC AXIAL PISTON MACHINE WITH A SWASHPLATE CONSTRUCTION

(75) Inventor: Franz Forster, Karlstadt-Muhlbach (DE)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 09/717,169

(22) Filed: Nov. 20, 2000

(30) Foreign Application Priority Data

Nov. 30, 1999 (DE) ..... 199 57 566

(51) Int. Cl.[7] ..... F16H 47/04
(52) U.S. Cl. ..... 475/83; 91/505; 417/222.1
(58) Field of Search ..... 475/83; 60/487, 60/413, 435, 451; 417/222.1, 540, 269, 18, 22, 216; 91/505, 361; 472/43

(56) References Cited

U.S. PATENT DOCUMENTS 4,543,876 A * 10/1985 Heyl et al. ..... 417/222.1
4,615,257 A * 10/1986 Valentin ..... 91/487
5,391,123 A * 2/1995 Forster ..... 475/83
5,397,281 A * 3/1995 Forster ..... 475/83
5,528,978 A * 6/1996 Forster ..... 475/337
5,642,617 A * 7/1997 Larkin et al. ..... 188/DIG. 1
6,135,259 A * 10/2000 Forster ..... 91/487
6,152,014 A * 11/2000 Willimczik ..... 91/499
6,206,650 B1 * 3/2001 Thurner ..... 417/269

FOREIGN PATENT DOCUMENTS

DE 3423467 4/1986 ..... F04B/1/14
DE 198 05 300 A 1 * 8/1999 ..... B60K/17/14

* cited by examiner

*Primary Examiner*—Rodney H. Bonck
*Assistant Examiner*—David D. Le
(74) *Attorney, Agent, or Firm*—Webb Ziesenheim Logsdon Orkin & Hanson, P.C.

(57) ABSTRACT

A hydrostatic axial piston machine with a swashplate construction formed with an axially short construction. The cylinder block has a plurality of bores received in movable pistons. The pistons are each supported by respective slippers through a slipper joint on a swashplate. The center points of the slipper joints are located in a plane, the intersection point of the plane with the axis of rotation of the cylinder block is in an end surface of the cylinder block that contains the piston exit openings or in an area of the cylinder block that is adjacent to the end surface. The cylinder block is rotationally mounted in the vicinity of the intersection point of the plane with the axis of rotation. The center points of all the slipper joints are preferably located inside the axial extension of the bores in the cylinder block so that transverse piston forces are absorbed direction in the cylinder block. The slipper joints may be connected by a connecting rod with the corresponding slipper. The cylinder block may include an external bearing system connected with a centrally located torque rod.

19 Claims, 4 Drawing Sheets

HYDROSTATIC AXIAL PISTON MACHINE WITH A SWASHPLATE CONSTRUCTION

CROSS-REFERENCE TO RELATED APPLICATION

This application claims priority to German Application No. 199 57 566.5 filed Nov. 30, 1999, herein incorporated by reference.

BACKGROUND OF THE INVENTION

1. Field of the Invention

This invention relates generally to a hydrostatic axial piston machine having a swashplate construction with a cylinder block in which there are a plurality of bores with pistons that can move longitudinally in the bores. The pistons are each supported by a slipper on a swashplate, with the slippers connected with the pistons by a slipper joint, in particular by a ball joint.

2. Technical Considerations

Axial piston machines of the above type are known in numerous embodiments in the known art. A distinction between machines is thereby made by the type of cylinder block bearing system, i.e., an internal bearing system and an external bearing system for the cylinder block. With a conventional internal bearing system, the cylinder block is mounted on a rotating shaft that is supported in the machine housing by roller bearings. The cylinder block is driven by a shaft gearing which makes possible both axial mobility of the cylinder block and a limited angular adjustability. The position of the cylinder block can thereby be adapted to the position of the port plate. The cylinder block is supported on the shaft at the intersection of the plane containing the center points of the slipper joints with the axis of rotation of the cylinder block or the axis of rotation of the shaft. In known axial piston machines, this intersection lies axially outside the cylinder block (i.e., axially between the cylinder block and the swashplate). Therefore, on axial piston machines that have a cylinder block with an internal bearing system, the cylinder block is elongated toward the swashplate by a throat. On axial piston machines with a cylinder block that has an external bearing system, instead of the throat there is a collar on the outer periphery of the cylinder block. The measures described above (throat or collar on the cylinder block) result in a certain minimum length of the axial piston machine.

DE 34 23 467 C2 discloses an axial piston machine in which the intersection of the plane of the center points of the slipper joints with the axis of rotation of the cylinder block also lies outside the cylinder block, although the cylinder block has neither a throat nor a collar. These components are not necessary because a conical bearing, namely an angular ball bearing, a conical roller bearing, or a friction bearing, is used as the cylinder block bearing system. This type of cylinder block bearing system can be used both for the external bearing system and for the internal bearing system of the cylinder block. On this known axial piston machine, however, one disadvantage is that when the cylinder block becomes worn in the vicinity of the port plate and wear plate, there is no possibility for a readjustment of the cylinder block in the axial direction, which is limited by the conicity of the cylinder block bearing.

Therefore, it would be advantageous to provide a compact hydrostatic axial piston machine of the type described above that can be used in many different applications and has an improved cylinder block bearing system.

SUMMARY OF THE INVENTION

The invention provides an axial piston machine in which the center points of the slipper joints are located in a plane, the intersection of which plane with the axis of rotation of the cylinder block is located in an end surface of the cylinder block that contains the piston exit openings or in an area of the cylinder block that is adjacent to this end surface. Because the invention teaches that the above mentioned intersection point is located axially inside the actual cylinder drum or on its swashplate-side outer periphery, the support of the cylinder block requires neither special components that are axially connected to the cylinder block and determine its length, nor conical bearings that restrict the freedom of movement of the cylinder block (adjustability). On the other hand, the cylinder block, in contrast to the indirect bearing systems of the prior art, can be supported directly in the area of the axial extension of the bores (friction bearings or roller bearings that are realized in the form of radial bearings). The axial piston machine of the invention can thereby be made very short in the axial direction.

The cylinder block is preferably supported by bearings in the area of the intersection of the plane of the center points of the slipper joints with the axis of rotation of the cylinder block.

In one particularly advantageous refinement of the invention, the center points of all the slipper joints are located inside the axial extension of the bores in the cylinder block. The transverse piston forces, in contrast to the swashplate motors of the prior art, are thereby not applied to the free ends of the piston, but are absorbed inside the axial extension of the bores in the cylinder block. Consequently, the pistons are no longer subjected to bending loads and can thereby be made significantly shorter, which has advantages with regard to the size of the axial piston machine. The guided length of the pistons in the bores of the cylinder block can be reduced with respect to the dimensions of systems of the prior art (corresponding to approximately 1.5 to 2.5 times the piston diameter) to a dimension that is sufficient to seal the bores. The dimension in the axial direction of the axial piston machine of the invention is therefore very small in relation to the displacement.

Finally, the mass of the pistons is also significantly reduced over that of conventional axial piston machines. The inertial forces are therefore also reduced. These reductions are reflected, for example, in a reduction of the load on the piston retraction device during operation of the axial piston machine of the invention in the form of a self-priming pump. The centrifugal forces generated during the rotation of the cylinder block are also reduced.

There are several possible methods to locate the center points of all the slipper joints inside the axial length of the bores in the cylinder block. For example, the maximum angle of adjustment of the swashplate can be reduced so that all the pistons are inserted all the way into the bores. By means of increased piston diameters and correspondingly enlarged intake cross sections, in this case it is at least partly possible to compensate for a reduction in the discharge or intake capacity of the axial piston machine of the invention. The result is a short-stroke machine which has the advantage of a low piston velocity.

In an additional configuration of the invention, the slipper joints are located in the pistons and each piston joint is connected with the corresponding slipper by a connecting rod. With an appropriate length of the connecting rods, it becomes possible to achieve a full insertion of the pistons into the corresponding bores with an unchanged large adjustment angle of the swashplate.

To prevent an increase in the weight of the slipper systems resulting from the presence of the connecting rods, or to at least partly compensate for such an increase, the invention teaches that it is advantageous if the slippers and/or the connecting rods and/or the slipper joints are made at least partly from a light metal alloy. Under some conditions, however, an increase in the weight of the slipper system can be acceptable if the slippers are combined with the short and therefore lightweight pistons described above.

The axial piston machine of the invention can be realized both in the form of a cylinder block with an internal bearing system and also in the form of a cylinder block with an external bearing system. If the cylinder block has an external bearing system, there are advantages with regard to the input/output of the cylinder block. In such a case, the cylinder block can be connected, instead of with a shaft that has to transmit both torsion forces as well as bending loads, with a centrally located torque rod. Such a torque rod, which is free of transverse forces, can have a diameter which is significantly smaller than the input/output shaft described above.

The cylinder block may be provided with a bearing system that permits an axial movement of the cylinder block, in particular a system of roller bearings. However, it is also possible to provide a system of friction bearings.

In one advantageous embodiment of the invention, a housing is provided with a housing base, whereby the housing base has a closable recess. A passage to another machine can be created through the recess.

It is also possible to locate an additional machine, in particular an auxiliary pump, in the recess of the housing floor. The additional machine is thereby integrated into the axial piston machine without increasing the outside dimensions of the axial piston machine.

In an additional embodiment of the invention, a gear train on the swash-plate side is coupled with the axial piston machine. In this manner, the speed of rotation of the axial piston machine can be increased and decreased.

If the gear train is realized in the form of a single-stage planetary gear train that has a sun wheel coupled with a transmission shaft and a ring gear coupled with the torque rod, the result on one hand is compact dimensions. On the other hand, when the axial piston machine of the invention is used as a pump, for example, the speed can be reduced to reduce noise and vibrations (e.g., ratio 2:1 for a single-stage planetary gear train, if the ring gear has twice the diameter of the sun wheel).

On the other hand, the additional machine can be operated with its speed of rotation unchanged, if the machine is coupled to the sun wheel of the planetary gear train and/or of the transmission shaft. It is also possible, however, to operate the axial piston machine and the additional machine at the same speed of rotation, e.g., by coupling the additional machine with the cylinder block and/or the torque rod.

In many applications, for example when the axial piston machine of the invention is used as a pump driven by an internal combustion engine of a hydrostatic traction drive system, the invention teaches that it is advantageous, with regard to noise reduction, if the torque rod is connected to the cylinder block with the interposition of a damping device.

BRIEF DESCRIPTION OF THE DRAWINGS

Additional advantages and details of the invention are explained in greater detail below with reference to the exemplary embodiments that are schematically illustrated in the accompanying figures, in which.

DESCRIPTION OF THE PREFERRED EMBODIMENTS

Figure 1:
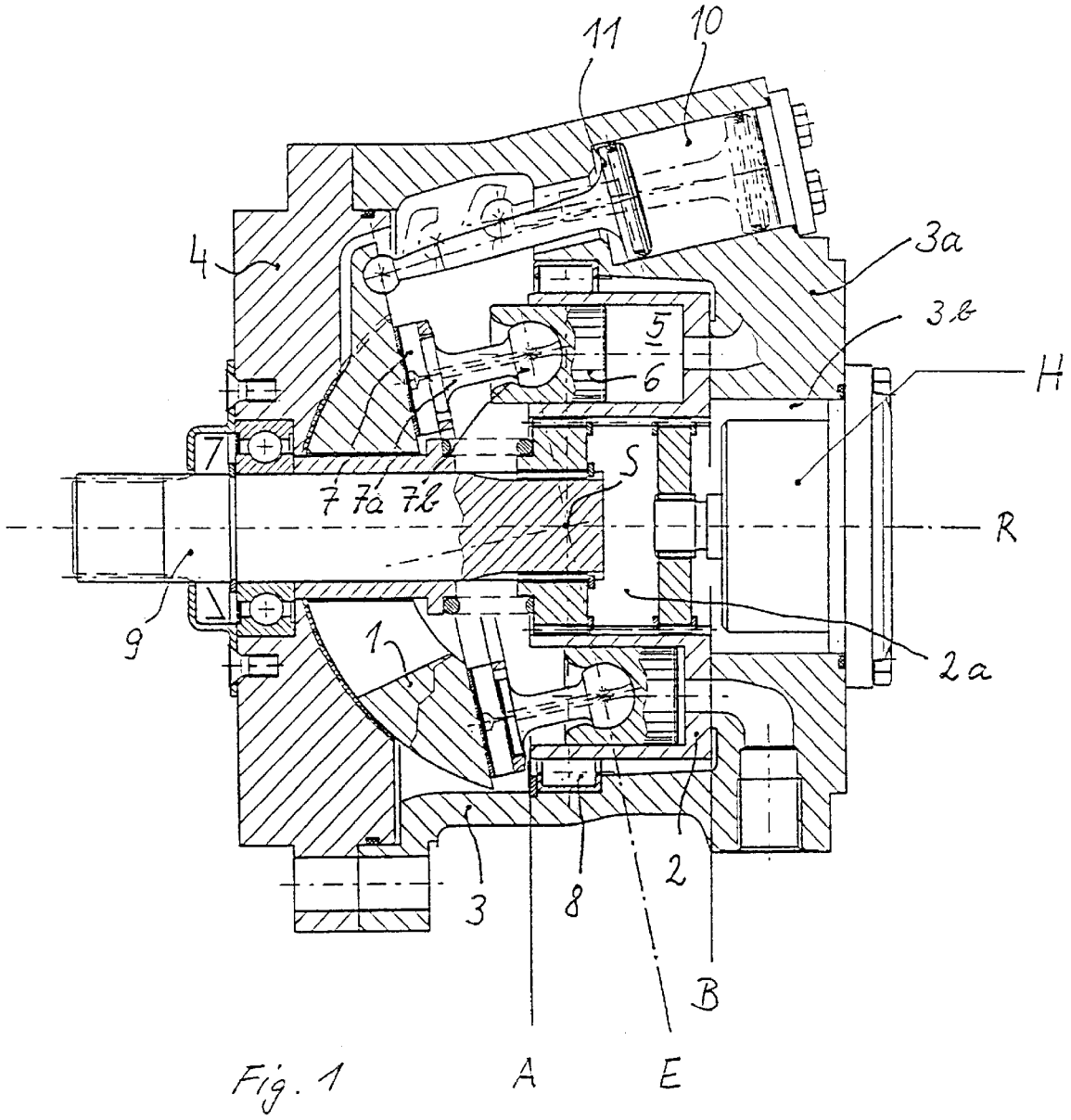
FIG. 1 is a sectional view through an axial piston machine of the invention with an auxiliary pump.

As set forth in FIG. 1, the axial piston machine of the invention has an adjustable swashplate 1, a cylinder block 2 with an external bearing system, a housing 3 and a cover 4 that closes the housing 3 and is preferably in the form of a swashplate mounting. The illustrated axial piston machine can be used as a pump, for example.

The cylinder block 2 has concentric bores 5 with pistons 6 that can move longitudinally inside them. The bores 5 are provided with oil by a control area B located on a housing base 3*a* of the housing 3. The pistons 6 are each supported by a respective slipper 7 on the swashplate 1. Each slipper 7 is connected by a connecting rod 7*a* with a slipper joint 7*b* that is realized in the form of a ball joint in the piston 6. The center points of the slipper joints 7*b* are located in a common plane E (illustrated in broken lines), which has an intersection point S with the axis of rotation R of the cylinder block 2.

The invention teaches that this intersection point S is located between an end surface A of the cylinder block 2 in which the bores 5 emerge on the swashplate side (i.e., the end surface A contains the piston exit openings) and the opposite end of the cylinder block 2 of the axial piston machine. The invention further comprises an arrangement in which the intersection point S lies in, e.g., in a plane containing, the end surface A, i.e., on the swashplate-side outer periphery of the cylinder block 2.

As a result of the location of the intersection point S, the cylinder block 2 can be supported in the vicinity of its outside cylindrical surface, for example by an external bearing system in the housing 3, which in this exemplary embodiment is accomplished by a system of roller bearings 8 in the vicinity of the intersection point S. Therefore, there is no longer any need for the collars that elongate the cylinder block and thus determine the axial dimensions of the axial piston machine and which are necessary on most of the axial piston machines of the prior art. The result is a shorter construction of the axial piston machine. This result is achieved on internal bearing systems and on external bearing systems, because in this case there is no need for the throat that is required on machines of the prior art.

This exemplary embodiment also realizes an important refinement of the invention. In this case the center points of all the slipper joints 7*b* are located inside the axial length of the bores 5 (in the exemplary embodiment illustrated, the center point of the slipper joint 7*b* of the piston 6 that is extended farthest out of its bore 5 lies on the plane A which is still part of the axial length of the bore 5). The transverse piston forces therefore are not applied to the free ends of the pistons 6, but are located inside the axial extension of the bores 5 in the cylinder block 2. It thereby becomes possible to make the pistons 6 significantly shorter, because the pistons are not subject to bending and the surface pressure in the bores is drastically reduced. The guide length of the pistons 6 in the bores 5 of the cylinder block 2 can be reduced to the length that is necessary to seal the bores 5. The dimension of the axial piston machine in the axial direction is therefore very small in relation to the displacement. The weight of the short pistons 6 is also significantly less than conventional pistons, which reduces the inertial forces.

To keep the dimensions of the rotating slipper systems from becoming larger in comparison to systems that do not have connecting rods, the slippers 7 and/or the connecting rods 7*a* and/or the slipper joints 7*b* may be made at least partly from a light metal alloy.

In a central recess 2*a* of the cylinder block 2, a torque rod 9, which is free of transverse forces, is connected with the cylinder block 2. The torque rod 9 is mounted in the cover 4, as a result of which the axial piston machine of the invention can be used as a component in almost any desired type of drive system. In this case the torque rod 9 is realized in the form of an input shaft when the axial piston machine is used as a pump, and in the form of an output shaft when the axial piston machine is used as a motor. The use of a torque rod makes possible an extremely compact construction of the axial piston machine of the invention.

To adjust the swashplate 1, there are actuator cylinders 10 and actuator pistons 11 that can move longitudinally in the actuator cylinders 10 and are effectively connected with the swashplate 1. (In FIG. 1, however, only one of two single-action actuator pistons are shown; the second actuator cylinder is symmetrical to the actuator cylinder shown with reference to the axis of rotation R.) Both the actuator cylinder 10 and the actuator piston 11 are oriented at an angle with respect to the axis of rotation R, whereby an acute angle is preferably formed between the actuator cylinder 10/actuator piston 11 and the axis of rotation R.

The housing base 3*a* is provided with a closable recess 3*b*. In the exemplary embodiment of the axial piston machine shown in FIG. 1, an auxiliary pump H is located in the recess 3*b*. The location takes up no more space than the axial piston machine without an auxiliary pump.

In the exemplary embodiment illustrated in FIG. 1, the auxiliary pump H is driven by the cylinder block 2 and thus by the torque rod 9, which means that both the axial piston machine and the auxiliary pump H have the same speed of rotation.

Figure 2:
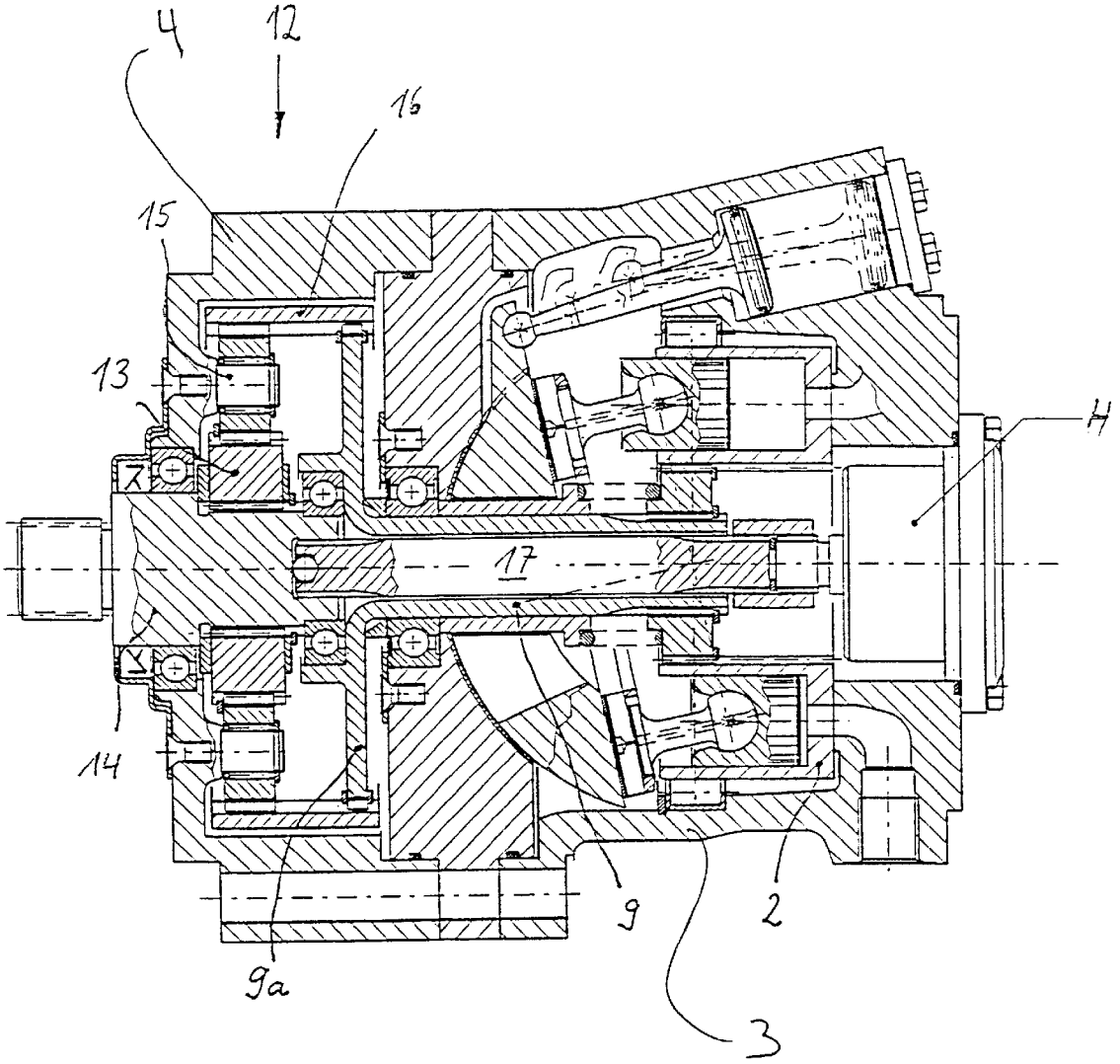
FIG. 2 is a sectional view through an axial piston machine of the invention with an auxiliary pump and a gear train.

In the exemplary embodiment illustrated in FIG. 2, the cover 4 is next to a single-stage planetary gear train 12, the sun wheel 13 of which is connected in synchronous rotation with a transmission shaft 14. A web 15 of the planetary gear train 12 is fixed to the housing 3. A ring gear 16 is connected by a driver disc 9*a* shaped onto the torque rod 9 with the cylinder block 2. When the axial piston machine is used as a pump, a speed reduction can be achieved in spite of its still compact dimensions, for example to reduce the noise and vibrations generated and/or to reduce hydraulic losses.

In the exemplary embodiment illustrated in FIG. 2, the auxiliary pump H is not connected with the cylinder block 2 or with the torque rod 9, but with a drive rod 17 which is located inside the hollow torque rod 9 and is coupled with the transmission shaft 14. The auxiliary pump H therefore has the same speed of rotation as the transmission shaft 14, while the speed of the cylinder block 2 is reduced by the planetary gear train 12.

Figure 3:
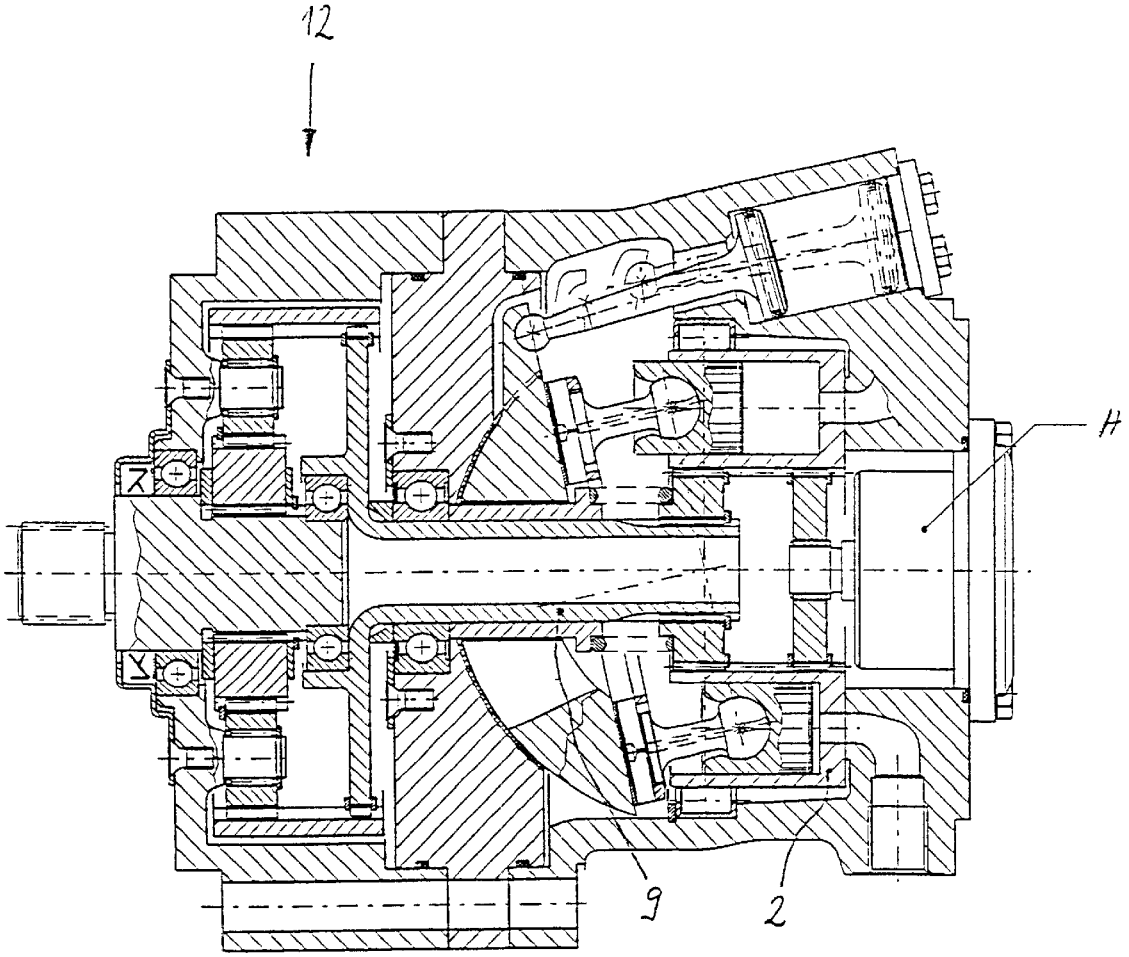
FIG. 3 is a sectional view through a variant of the axial piston machine of the invention illustrated in FIG. 2.

In the exemplary embodiment illustrated in FIG. 3, the auxiliary pump H, analogous to the configuration illustrated in FIG. 1, is driven directly by the cylinder block 2 and thus by the torque rod 9. Because the cylinder block 2 is driven at reduced speed by the planetary gear train 12, the same is true for the auxiliary pump H.

Figure 4:
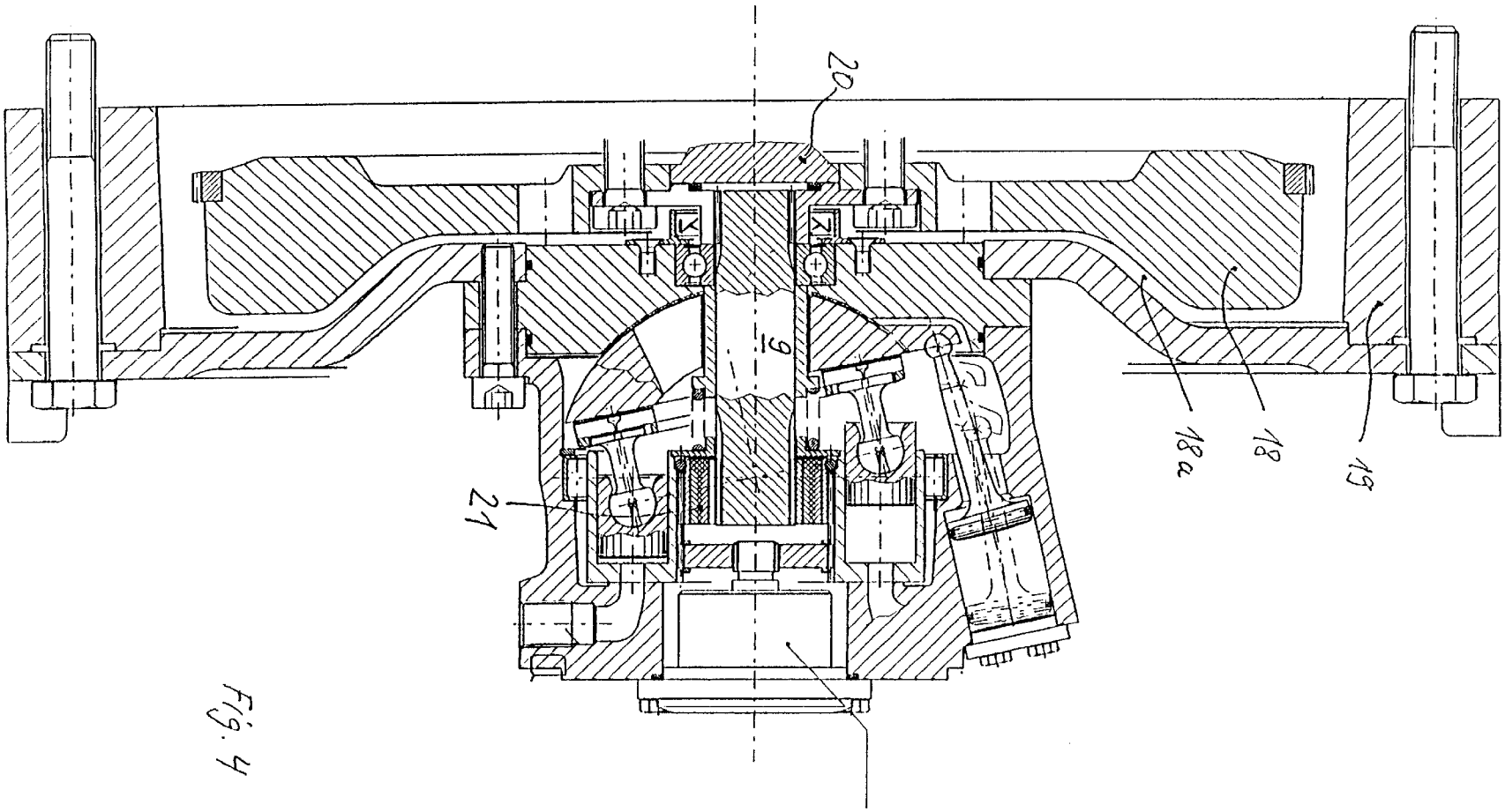
FIG. 4 is a sectional view through an axial piston machine of the invention with a damping device in combination with a flywheel.

The exemplary embodiment illustrated in FIG. 4 shows an arrangement with the axial piston machine of the invention and a flywheel 18. The system is provided for attachment to an internal combustion engine that is not shown in the figure. In this case the flywheel 18, which is located in a flywheel housing 19, is connected with a crankshaft 20 of the internal combustion engine so that they rotate synchronously. The axial piston machine is next to the flywheel 18 and extends into a recess 18*a* of the flywheel 18.

The torque rod 9 is connected on its end farther from the flywheel 18 with a damping device 21 which is made of an elastomer material, for example. On one hand, the damping device 21 on a system that is designed to be extremely short, as a result of the use of the axial piston machine of the invention, makes possible a significant noise reduction. On the other hand, compensation can be achieved for eccentricities between the crankshaft 20 or the flywheel 18 and the axial piston machine, as well as for dimensional tolerances in the axial direction.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

I claim:

1. A hydrostatic axial piston machine with a swashplate construction, comprising:

a cylinder block having a plurality of bores with piston exit openings;

pistons longitudinally movable in the bores, wherein the pistons are each supported by respective slippers on a swashplate, wherein each slipper is connected with a respective piston by a slipper joint, wherein center points of the slipper joints are located in a plane, wherein an intersection point of the plane with an axis of rotation of the cylinder block is located in an end surface of the cylinder block that contains the piston exit openings or in an area of the cylinder block that is adjacent to this end surface.

2. The hydrostatic axial piston machine as claimed in claim 1, wherein each slipper joint is a ball joint.

3. The hydrostatic axial piston machine as claimed in claim 1, wherein the center points of all the slipper joints are located inside an axial extension of the bores in the cylinder block.

4. The hydrostatic axial piston machine as claimed in claim 1, wherein the slipper joints are located in the pistons and each slipper joint is connected by a connecting rod with a corresponding slipper.

5. The hydrostatic axial piston machine as claimed in claim 4, wherein at least one of the slippers, the connecting rods, and the slipper joints are made at least partly of a metal alloy.

6. The hydrostatic axial piston machine as claimed in claim 1, wherein the cylinder block has an external system of bearings.

7. The hydrostatic axial piston machine as claimed in claim 6, wherein the cylinder block includes a centrally located torque rod.

8. The hydrostatic axial piston machine as claimed in claim 6, wherein the cylinder block is mounted by a bearing system which allows an axial movement of the cylinder block.

9. The hydrostatic axial piston machine as claimed in claim 8, wherein the bearing system is a roller bearing system.

10. The hydrostatic axial piston machine as claimed in claim 1, further comprising a housing having a housing base, wherein the housing base has a closable recess.

11. The hydrostatic axial piston machine as claimed in claim 10, further including an additional machine in the recess of the housing base.

12. The hydrostatic axial piston machine as claimed in claim 11, wherein the additional machine is an auxiliary pump.

13. The hydrostatic axial piston machine as claimed in claim 1, wherein the cylinder block is rotationally mounted in the vicinity of the intersection point of the plane with the axis of rotation of the cylinder block.

14. The hydrostatic axial piston machine as claimed in claim 13, wherein the center points of all the slipper joints are located inside an axial extension of the bores in the cylinder block.

15. A hydrostatic axial piston machine with a swashplate construction, comprising:

a cylinder block having a plurality of bores with piston exit openings;

pistons longitudinally movable in the bores, wherein the pistons are each supported by respective slippers on a swashplate, wherein each slipper is connected with a respective piston by a slipper joint, wherein center points of the slipper joints are located in a plane, wherein an intersection point of the plane with an axis of rotation of the cylinder block is located in an end surface of the cylinder block that contains the piston exit openings or in an area of the cylinder block that is adjacent to this end surface, wherein the cylinder block includes a centrally located torque rod, and further including a gear train located on a swashplate side and coupled with the axial piston machine.

16. The hydrostatic axial piston machine as claimed in claim 15, wherein the gear train is a planetary gear train which has a sun wheel coupled with a transmission shaft and a ring gear coupled with the torque rod.

17. The hydrostatic axial piston machine as claimed in claim 16, including a housing having a base with a closable recess, with an additional machine located in the recess and coupled with at least one of the sun wheels of the planetary gear train and the transmission shaft.

18. The hydrostatic axial piston machine as claimed in claim 16, including a housing having a housing base with a recess, with an additional machine located in the recess and coupled with at least one of the cylinder blocks and the torque rod.

19. A hydrostatic axial piston machine with a swashplate construction, comprising:

a cylinder block having a plurality of bores with piston exit openings;

pistons longitudinally movable in the bores, wherein the pistons are each supported by respective slippers on a swashplate, wherein each slipper is connected with a respective piston by a slipper joint, wherein center points of the slipper joints are located in a plane, wherein an intersection point of the plane with an axis of rotation of the cylinder block is located in an end surface of the cylinder block that contains the piston exit openings or in an area of the cylinder block that is adjacent to this end surface, wherein the cylinder block includes a centrally located torque rod, and wherein the torque rod is connected with the cylinder block with the interposition of a damping device.

* * * * *